US005253804A

United States Patent [19]

Sarazen, Jr. et al.

[11] Patent Number: 5,253,804

[45] Date of Patent: Oct. 19, 1993

[54] TEMPERATURE AND HUMIDITY SENSITIVE HIGH EFFICIENCY EXHAUST VENTILATOR APPARATUS

[76] Inventors: Paul M. Sarazen, Jr., 214 Fairview Dr.; Dennis A. Beam, Jr., 410 Westfield Dr., both of Shelby, N.C. 28150

[21] Appl. No.: 882,182

[22] Filed: May 12, 1992

[51] Int. Cl.[5] ..... B01F 3/02; F24F 7/00

[52] U.S. Cl. ..... 236/44 C; 236/49.5; 454/256

[58] Field of Search ..... 236/49.5, 49.2, 44 C; 454/256, 258, 272

[56] References Cited

U.S. PATENT DOCUMENTS

| | | | |
|---|---|---|---|
| 302,215 | 7/1884 | Tucker . | |
| 1,335,929 | 4/1920 | Allen . | |
| 1,358,193 | 11/1920 | Fulton . | |
| 1,781,155 | 11/1930 | Anderson | 417/423.15 |
| 2,117,529 | 5/1938 | Wile et al. | 236/1 R |
| 2,187,767 | 1/1940 | Akers . | |
| 2,216,873 | 10/1940 | Browne . | |
| 2,241,108 | 5/1941 | Akers . | |
| 2,407,284 | 9/1946 | Kennedy | 236/49.5 X |
| 2,510,524 | 6/1950 | Schramm . | |
| 2,551,965 | 5/1951 | Petersen et al. . | |
| 2,814,977 | 12/1957 | Noll . | |
| 2,975,975 | 3/1961 | Weber | 236/49.5 |
| 3,027,090 | 3/1962 | Zerhan, Jr. | 236/49.5 |
| 3,068,776 | 12/1962 | Day . | |
| 3,150,584 | 9/1964 | Allander . | |
| 3,195,441 | 7/1965 | Hedrick . | |
| 3,202,082 | 8/1965 | Viehmann . | |
| 3,220,079 | 11/1965 | Aggson . | |
| 3,221,632 | 12/1965 | Copp . | |
| 3,368,756 | 2/1968 | Edwards | 236/49.5 |
| 3,436,016 | 4/1969 | Edwards | 236/49.5 |
| 3,528,606 | 9/1970 | Witten | 236/48 |
| 3,741,102 | 6/1973 | Kaiser | 49/90 X |
| 3,974,754 | 8/1976 | Powlesland et al. . | |
| 4,006,672 | 2/1977 | Matsuyoshi et al. . | |
| 4,136,822 | 1/1979 | Felter | 236/91 G X |
| 4,151,952 | 5/1979 | Edwards | 236/101 D |
| 4,175,480 | 11/1979 | Beam, Jr. et al. | 236/49.1 X |
| 4,208,010 | 6/1980 | Beam, Jr. et al. . | |
| 4,210,279 | 7/1980 | McSwain | 236/49.5 |
| 4,231,514 | 11/1980 | McSwain | 137/625.28 X |
| 4,243,175 | 1/1981 | McSwain | 236/101 D X |
| 4,249,460 | 2/1981 | McSwain | 160/95 X |
| 4,274,330 | 6/1982 | Witten et al. | 160/131 X |
| 4,290,554 | 9/1981 | Hensley | 236/101 D |
| 4,328,927 | 5/1982 | McSwain | 236/101 D X |
| 4,417,687 | 11/1983 | Grant | 49/84 X |
| 4,493,456 | 1/1985 | Sarazen, Jr. et al. | 403/408 X |
| 4,587,892 | 5/1986 | Witten et al. . | |
| 4,669,371 | 6/1987 | Sarazen, Jr. et al. | 52/573 X |
| 4,676,145 | 6/1987 | Allred | 52/209 |
| 4,715,532 | 12/1987 | Sarazen, Jr. | 403/298 |
| 4,754,696 | 7/1988 | Sarazen et al. | 52/573 |
| 4,821,628 | 4/1989 | Sarazen, Jr. et al. . | |
| 4,829,882 | 5/1989 | Jakcson | 236/49.1 X |
| 4,962,882 | 10/1990 | Sarazen, Jr. et al. | 236/49.5 |

FOREIGN PATENT DOCUMENTS

| | | | |
|---|---|---|---|
| 545591 | 10/1922 | France . | |
| 55-121335A | 9/1980 | Japan . | |
| 56-53331A | 5/1981 | Japan . | |
| 0127044 | 5/1988 | Japan | 236/49.5 |
| 52231 | 7/1910 | Switzerland . | |
| 115922A | 9/1983 | United Kingdom . | |

OTHER PUBLICATIONS

The Power Temp-Vent® Suction Model (Model-S) Moisture Reduction for Crawl Space Homes (May 17, 1991).

*Primary Examiner*—William E. Wayner
*Attorney, Agent, or Firm*—Dority & Manning

[57] ABSTRACT

A temperature and humidity controlled fan for ventilating a building foundation including a housing mounted in the foundation wall. The housing includes the fan and a temperature responsive ganged louver arrangement for opening and closing the housing for ventilation usage.

17 Claims, 4 Drawing Sheets

50
4
78
74
28
44
79
76
86
70
78
46
84
88
84
38
79
86
40
80
102
4
92

74
28
52
88
38
40
92
92
104
106
92
92
34
34
36
110V
A/C
92
92

TEMPERATURE AND HUMIDITY SENSITIVE HIGH EFFICIENCY EXHAUST VENTILATOR APPARATUS

BACKGROUND OF THE INVENTION

The present invention relates to an exhaust ventilator structure of the type that is normally disposed in the foundation of a dwelling or other building structure. More particularly, the present invention relates to a ventilator with an electrically powered fan which expels air from within the building structure to the outside environment.

A number of ventilators with automatic, temperature responsive louvers are known, including French Patent No. 1,377,998 and those disclosed in the following U.S. Patents:

| U.S. Pat. No. | Inventive Entity |
|---|---|
| 4,962,882 | Sarazen, Jr. et al |
| 4,754,696 | Sarazen et al |
| 4,715,532 | Sarazen, Jr. et al |
| 4,669,371 | Sarazen, Jr. et al |
| 4,493,456 | Sarazen, Jr. et al |
| 4,328,927 | McSwain |
| 4,290,554 | Hensley |
| 4,274,330 | Witten et al |
| 4,243,175 | McSwain |
| 4,231,514 | McSwain |
| 4,210,279 | McSwain |
| 4,208,010 | Beam, Jr. et al |
| 4,175,480 | Beam, Jr. et al |
| 4,151,952 | Edwards |
| 3,528,606 | Witten |
| 3,436,016 | Edwards |
| 3,368,756 | Edwards |
| 3,195,441 | Hedrick |
| 3,068,776 | Day |
| 3,027,090 | Zerhan, Jr. |
| 2,975,975 | Weber |
| 2,814,977 | Noll |
| 2,551,965 | Petersen et al |
| 2,241,108 | Akers |
| 2,216,873 | Browne |
| 2,187,767 | Akers |
| 2,117,529 | Wile et al |
| 1,358,193 | Fulton |
| 1,335,929 | Allen |
| 302,215 | Tucker |

A bimetallic element provides a temperature operative mechanism to open and close the shutter elements of many of these vents.

A number of ventilators powered by a fan are known, including: Japanese Publication No. 55-121335A to Nobutou, Japanese Patent Publication 56-53331A to Nakamura, U.K. Patent Application GB 2 115 922A to Eccles, Brevet d'Invention No. 545,591 to Mertz, and those disclosed in the following U.S. Patents:

| U.S. Pat. No. | Inventive Entity |
|---|---|
| 4,829,882 | Jackson |
| 4,136,822 | Felter |
| 4,006,672 | Matsuyoshi et al |
| 3,974,754 | Powlesland et al |
| 2,510,524 | Schramm |

Some of these patents disclose the use of humidity sensors and temperature sensors to control operation of the fan.

OBJECTS AND SUMMARY OF THE INVENTION

It is a principal object of the present invention to provide an improved apparatus for controlling the humidity, quality, and temperature of the air disposed in the space beneath the floors and in the vicinity of foundations of building structures.

It also is a principal object of the present invention to provide an foundation ventilator apparatus for controlling the humidity, quality, and temperature of the air disposed in the space beneath the floors and in the vicinity of foundations of building structures.

It is a further principal object of the present invention to provide a foundation ventilator apparatus having an air passageway with an opening that is self-regulating for powered exhaust by fan disposed in the ventilator housing and controllable according to the temperature and/or humidity of the air disposed in the space beneath the floors and in the vicinity of foundation walls of building structures in which the ventilator apparatus is mounted.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a preferred embodiment of the temperature-responsive powered-fan foundation ventilator apparatus of the present invention includes at least one ventilator of a first type, at least one ventilator of a second type, control apparatus contained within a housing mounted to the building structure, and at least one manually operated switch which can be disposed inside the habitable portion of the building structure and connected to an electric power supply for the structure. The first ventilator is powered in the sense of having an electrically powered fan and is temperature-responsive in at least the sense of having an automatic means for opening and closing the air passageway of the ventilator depending upon the ambient temperature. A preferred embodiment of the temperature-responsive, powered-fan first ventilator comprises a louver housing, temperature responsive means for opening and closing the air passageway of the louver housing, a fan housing, a powered fan disposed inside the fan housing, an orifice plate disposed inside the fan housing with its orifice disposed around the fan blade of the fan. The control apparatus can include a humidistat, a thermostat, and one or more manually operable electric switches configured for controlling operation of the fan's motor. The particular details of each of the foregoing named elements of the apparatus of the present invention, including their configurations and interrelationships, are described below and in the drawings.

The accompanying drawings, which are incorporated in and constitute a part of this specification, illustrate at least one preferred embodiment of the invention and, together with the description, serve to explain the principles of the invention.

DETAILED DESCRIPTION OF THE PREFERRED EMBODIMENTS

Figure 1:
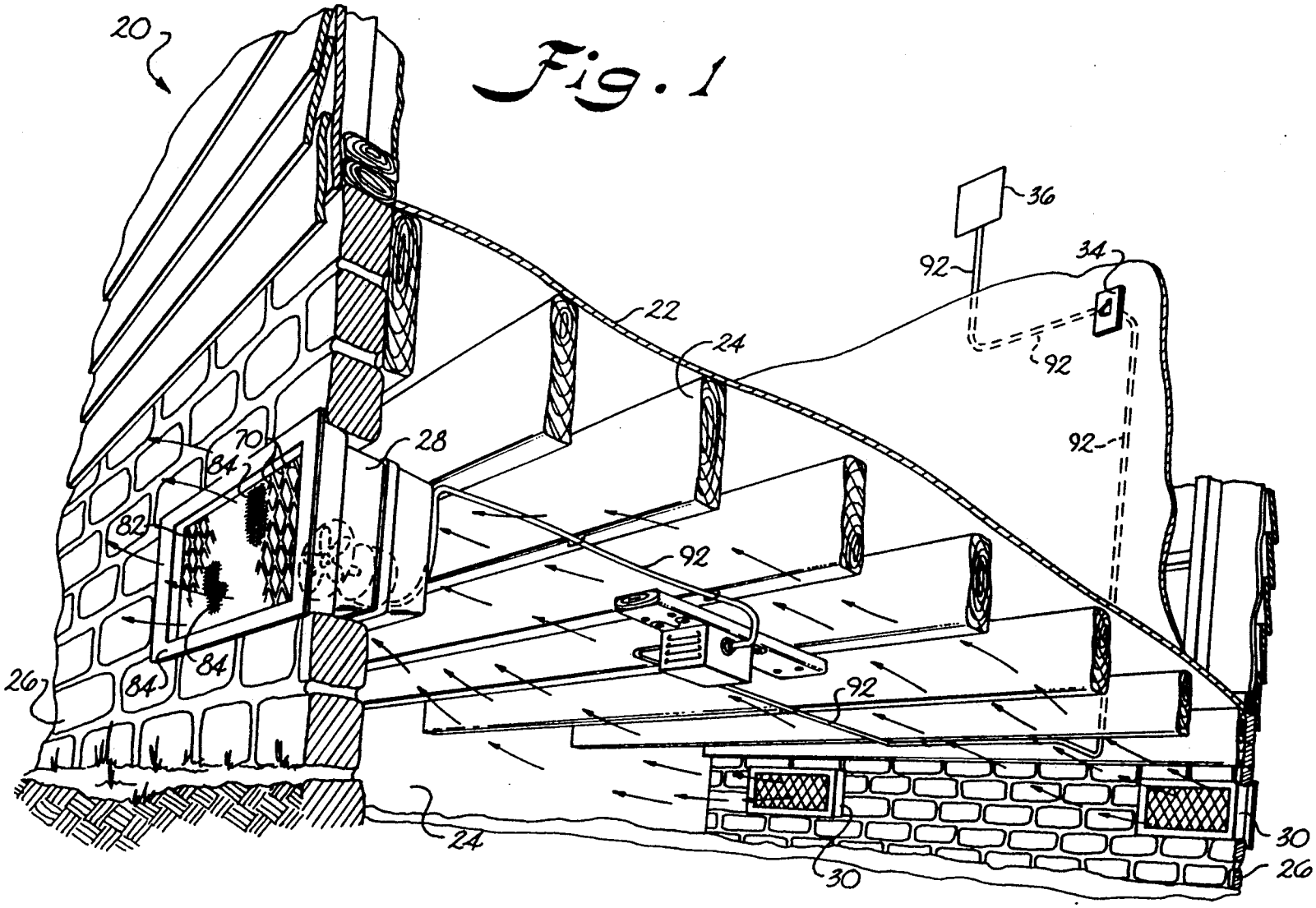
FIG. 1 illustrates an elevated perspective view of a preferred embodiment of the apparatus of the present invention and having certain components shown in phantom with dashed lines.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Repeat use of reference characters throughout the present specification and appended drawings is intended to represent same or analogous features or elements of the invention.

Figure 3:
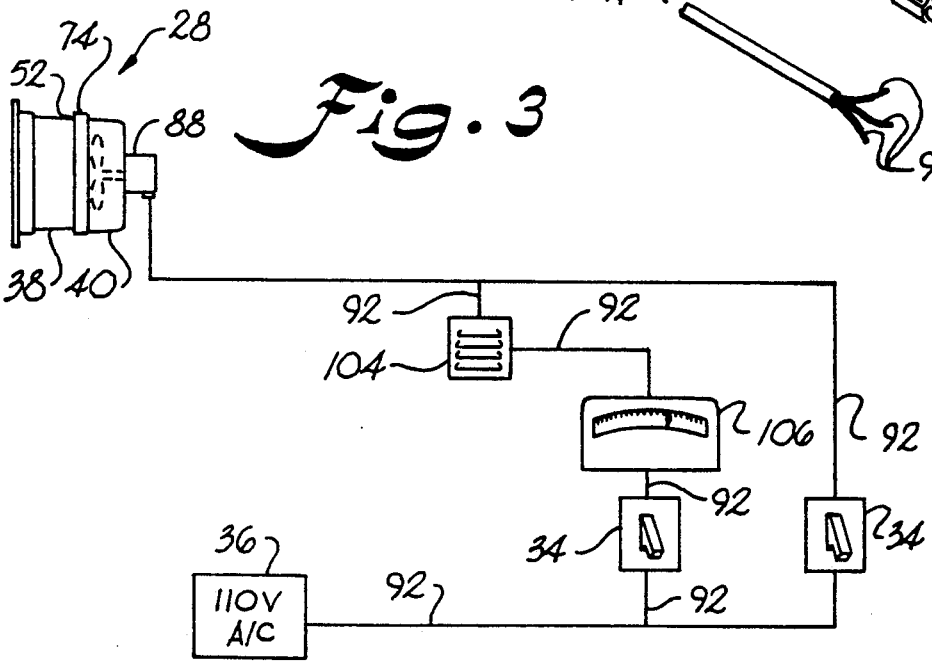
FIG. 3 illustrates a schematic illustration of a preferred embodiment of the apparatus of the present invention.
Figure 6:
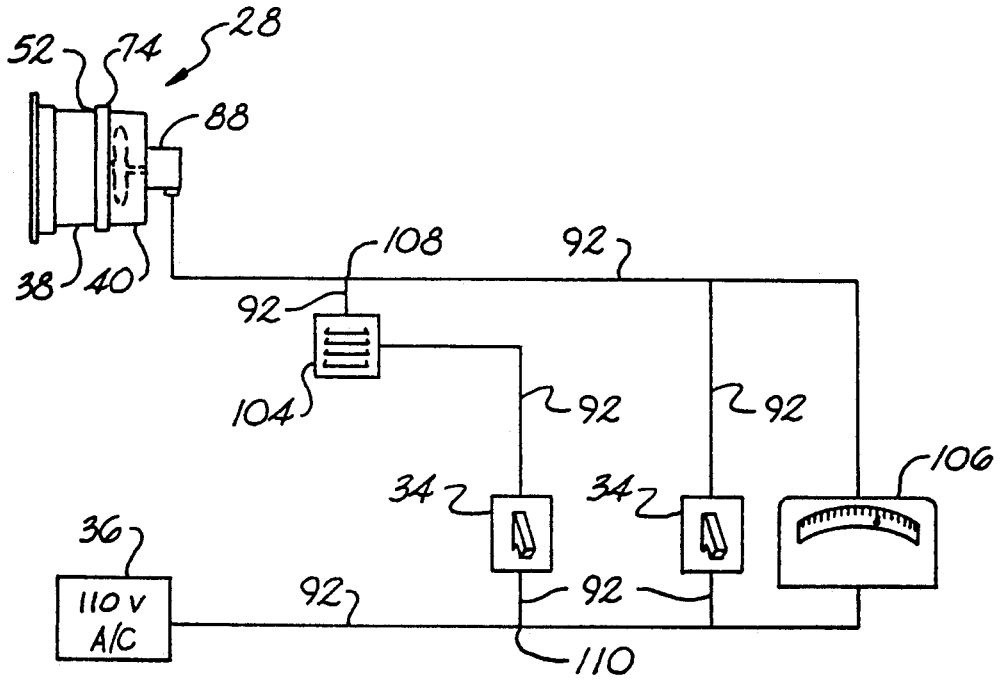
FIG. 6 illustrates a schematic illustration of a preferred embodiment of the apparatus of the present invention.

The present invention is directed to a temperature-responsive powered-fan foundation ventilator apparatus, which is usefully employed in the crawl space defined by the foundation walls and floor of a building structure or the cellar of a building structure, to control moisture and prevent the growth of fungus, mold, and the like which may adversely affect the structural integrity of the building. The apparatus also can be employed to change the air beneath the building structure and thereby prevent the build-up of undesirable levels of radon gas for example. A perspective view of a preferred embodiment of the apparatus is schematically illustrated in FIG. 1 installed in a building structure (generally designated by the numeral 20) beneath the floor 22 and in the crawl space 24 defined by the foundation walls 26 of the building 20. FIGS. 3 and 6 disclose schematic depictions of other preferred embodiments of the apparatus of the present invention. As will become apparent, further embodiments of the present invention can be obtained by combining one or more components from each of the disclosed embodiments.

In the preferred embodiment shown in FIG. 1, the apparatus of the present invention includes at least one ventilator 28 of a first type, at least one ventilator 30 of a second type (two second ventilators 30 being shown in FIG. 1), each second ventilator 30 being disposed generally opposite to the first ventilator 28, control apparatus contained within a housing 32 mounted to the building structure, and at least one manually operated switch 34, which as shown in FIG. 1 can be disposed inside the habitable portion of the building structure such as the kitchen for example and connected to an electric power supply (schematically designated by the box numbered 36) for the structure 20.

In accordance with the present invention, the first ventilator is powered in the sense of having an electrically powered fan and is temperature-responsive in at least the sense of having an automatic means for opening and closing the air passageway of the ventilator depending upon the ambient temperature. A preferred embodiment of the temperature-responsive, powered-fan first ventilator of the apparatus of the present invention is shown in FIGS. 1–6 and is represented generally by the numeral 28. The first ventilator of the present invention comprises two main parts, namely, a louver housing, which is indicated generally in FIGS. 2 and 4 for example by the numeral 38, and a fan housing, which is indicated generally in FIGS. 2 and 4 for example by the numeral 40. Both louver housing 38 and fan housing 40 are preferably manufactured of molded polymeric material.

As embodied herein and shown in FIGS. 1, 2, 3, 4, and 6, the structure and operation of the louver housing of the first ventilator can be the same as the structure and operation of any of a number of conventional temperature-responsive ventilators such as disclosed in the U.S. Patents listed above in the Background Section, the disclosures of such Patents being hereby incorporated into this patent application by this reference.

Figure 4:
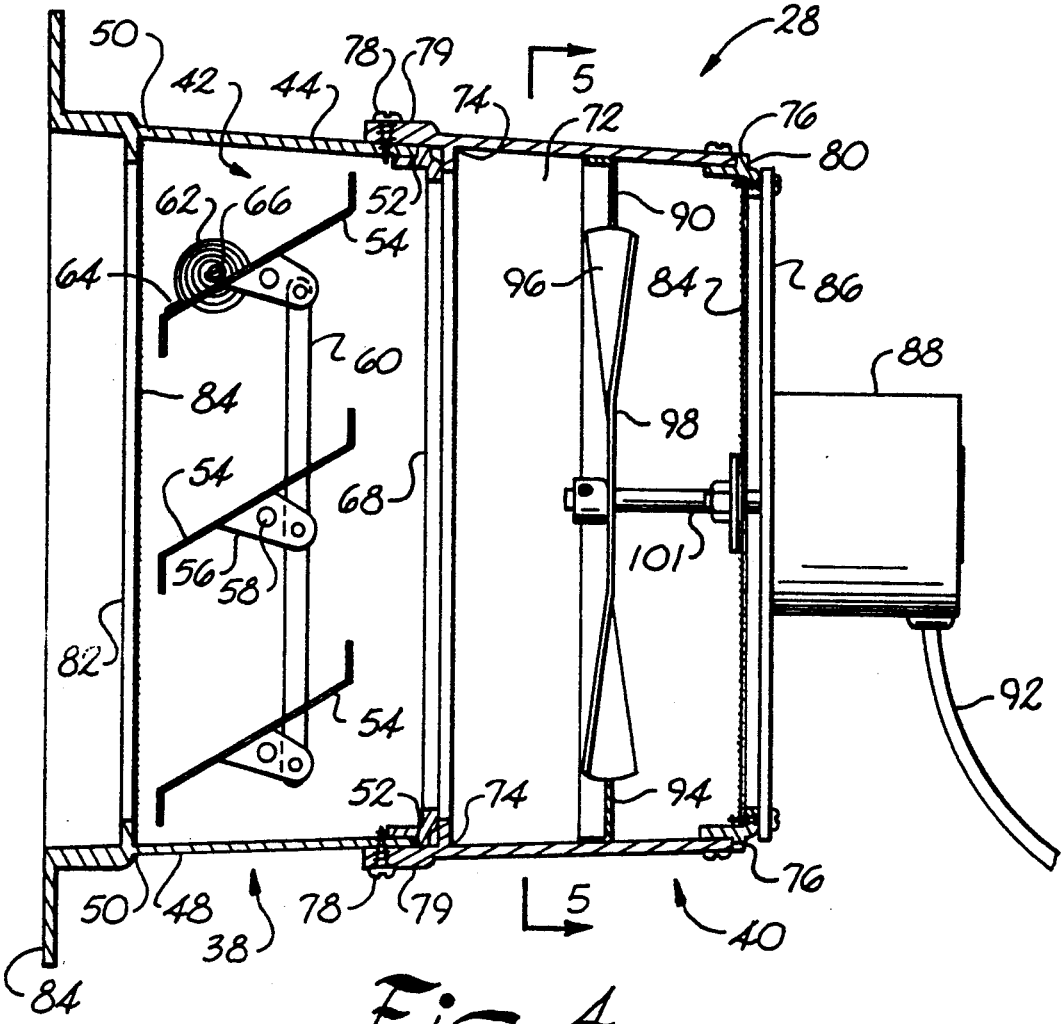
FIG. 4 illustrates a cross-sectional view taken along the lines 4—4 of FIG. 1.

In accordance with the apparatus of the present invention, the first ventilator is provided with a louver housing 38 which defines an air passageway 42 therethrough. As embodied herein and shown in one of FIGS. 2 and 4 for example, louver housing 38 preferably defines a unitary structure that includes a top 44, a first sidewall 46, a second sidewall disposed opposite first sidewall 46, and a bottom 48 disposed opposite top 44. As shown in FIG. 4 for example, louver housing 38, and accordingly each of top 44, bottom, and sidewalls 46, all of which define housing 38, defines a front edge 50 and a rear edge 52 disposed opposite front edge 50.

In accordance with at least the first ventilator of the present invention, means are provided for selectively opening and closing the louver housing air passageway depending upon temperature. This temperature dependent opening and closing means desirably is disposed in the air passageway of the louver housing. As embodied herein and shown in FIG. 4 for example, the temperature dependent opening and closing means desirably includes at least two elongated louvers 54 rotatably disposed across the air passageway 42. Each louver 54 defines a longitudinal axis of rotation which would be in the direction perpendicular to the plane of the paper on which FIG. 4 is depicted. Rotation of each louver 54 about its longitudinal axis functions to open the air passageway 42 to admit air and light through the first ventilator 28 in one position of the louvers 54 and functions to close the air passageway to prevent air and light from passing through the ventilator in a second position of the louvers.

The temperature dependent opening and closing means further includes a means for supporting each of the louvers for rotation about the longitudinal axis of rotation. As embodied herein and shown in FIG. 4 for example, the rotational supporting means can include for each louver 54 a support flange 56 pivotally mounted on a support post 58 connected to the sidewalls 46 of louver housing 38.

The temperature dependent opening and closing means also includes means for linking the louvers for simultaneous rotation about each longitudinal axis of rotation of each of the louvers. As embodied herein and shown in FIG. 4 for example, the linking means desirably includes an elongated drive element 60 pivotally connected to at least one of the louvers 54 and desirably connected pivotally to each of the louvers via respective support flanges 56.

In still further accordance with the present invention, a bimetallic element is provided as part of at least the first ventilator of the apparatus of the present invention, to provide the temperature sensitive means for opening and closing the ventilator to the passage of air therethrough. As embodied herein and shown in FIG. 4 for example, the temperature sensitive element preferably defines a bimetallic coil 62 having an inner free end 66 disposed at the innermost portion of the coil and an outer free end 64 disposed at the outermost circumference of the coil. Bimetallic coil 62 expands and contracts according to the temperature of its environment. The free end 64 outside the bimetallic coil 62 engages the drive element 60 pivotal connection via attachment to at least one of support flanges of louvers 54 for example. The opposite free end 66 disposed inside the coil 62 is desirably anchored to a structure connected to the walls 46 of the passageway of the louver housing 38. In operation, the expansion or contraction of coil 62 is transmitted to the louvers by movement of outer end 64 of coil 62. This movement results because inner end 66 is held fixed to one of the walls 46 defining the air passageway 42 of the louver housing 38. Movements of outer end 64 of coil 62 move drive element 60. Translational movement of drive element 60 by coil 62 results pivoting in movement of louvers 54, which are pivotally mounted to drive element 60 via respective support flanges 56. In so doing, coil 62 provides the necessary force to open and close first ventilator 28 to the passage of air therethrough. Other embodiments of the temperature dependent louver housing opening and closing means are disclosed in the temperature dependent ventilators listed above.

In some embodiments of the first ventilator of the apparatus of the present invention, as shown in FIG. 4 for example, a grill 68 is integrally connected to rear edge 52 of louver housing 38. Preferably, grill 68 is disposed across the air passageway 42 defined by louver housing 38 and defines open spaces through a grid work of members which constitute grill 68, such members being like the ones shown in FIG. 2 and designated by the numeral 70.

Figure 2:
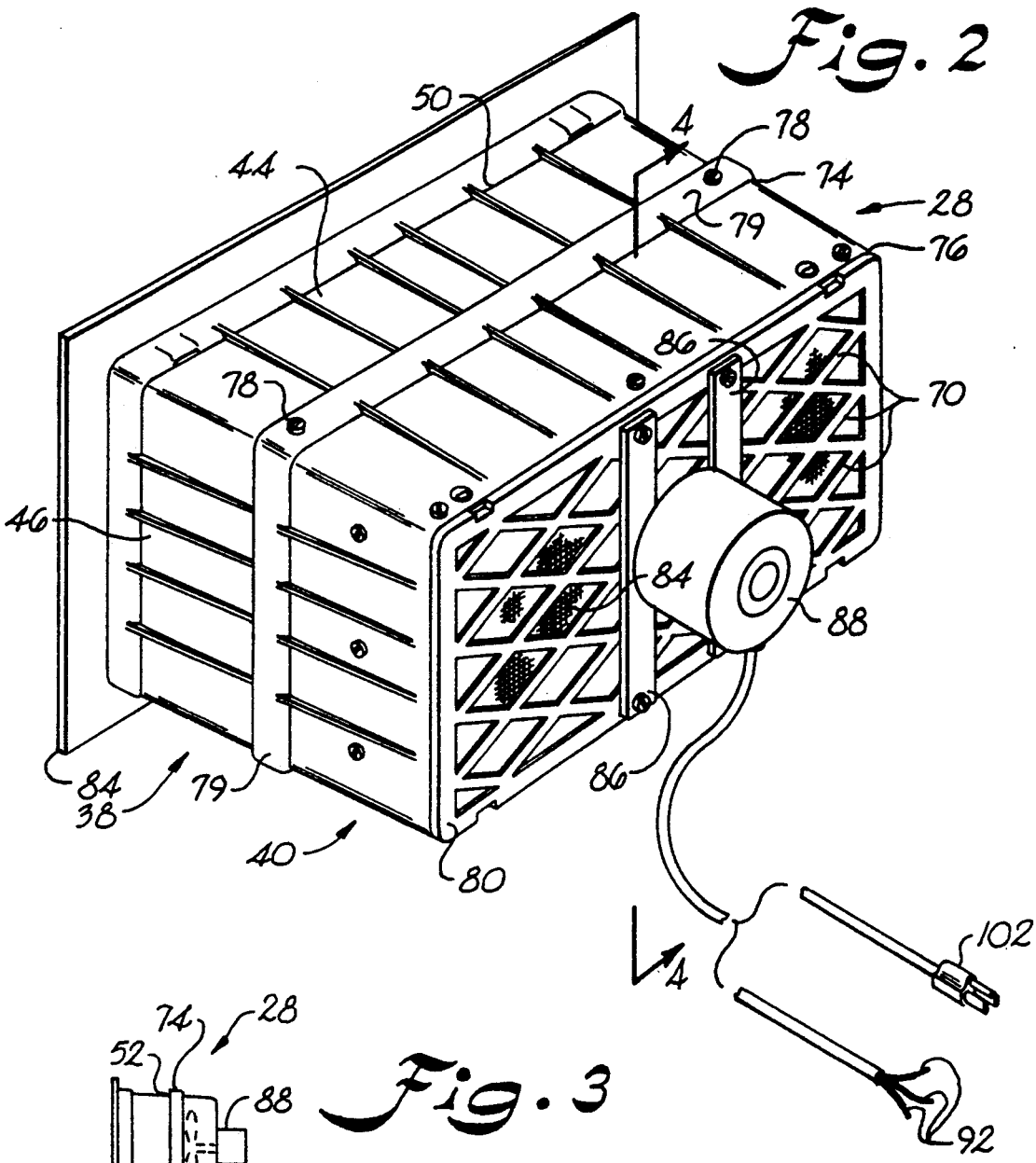
FIG. 2 illustrates an elevated perspective view of a preferred embodiment of the apparatus of the present invention from the rear.

In further accordance with the present invention, the first ventilator desirably includes a fan housing 40 that also defines an air passageway 72 therethrough. The fan housing desirably defines a front edge 74 and a rear edge 76 opposite to the front edge 74. As shown in FIGS. 1–4 and 6 for example, the front edge 74 of the fan housing 40 desirably is disposed in opposition to the rear edge 52 of the louver housing 38. As shown in FIGS. 2 and 4 for example, the two housings 38, 40 of first ventilator 28 are connected to one another by having the front edge 74 of fan housing 40 disposed in opposition to rear edge 52 of louver housing 38. As shown in FIGS. 2 and 4 for example, the two housings 38, 40 are attached together as by screws 78 through a connection flange 79 which overlaps rear edge of louver housing 38 and forms an integral forwardly disposed part of fan housing 40.

As shown in FIGS. 2 and 4 for example, a second grill 80 comprising a plurality of members 70 desirably is disposed across the air passageway 72 of fan housing 40 and in the vicinity of the rear edge 76 of fan housing 40. As shown in FIGS. 1 and 4 for example, a third grill 82 comprising a plurality of members 70 desirably is disposed across the air passageway 42 of louver housing 38 and in the vicinity of the front edge 50 and collar member 84 of louver housing 38. A screen 84 formed of nylon or metal can be disposed against the back side of each of second grill 80 or third grill 82 and respectively connected thereto to provide a finer filtering of air passing through grills 80 or 82. However, preferably no screen is provided across first grill 68 since first grill 68 is not intended to face the exterior environment of the foundation containing the first ventilator 28. Rather, the second and third grills 80, 82 are intended to face the exterior environment of the foundation containing the first ventilator 28. Screen 84 can be attached by heat sealing or applying a suitable adhesive.

Figure 5:
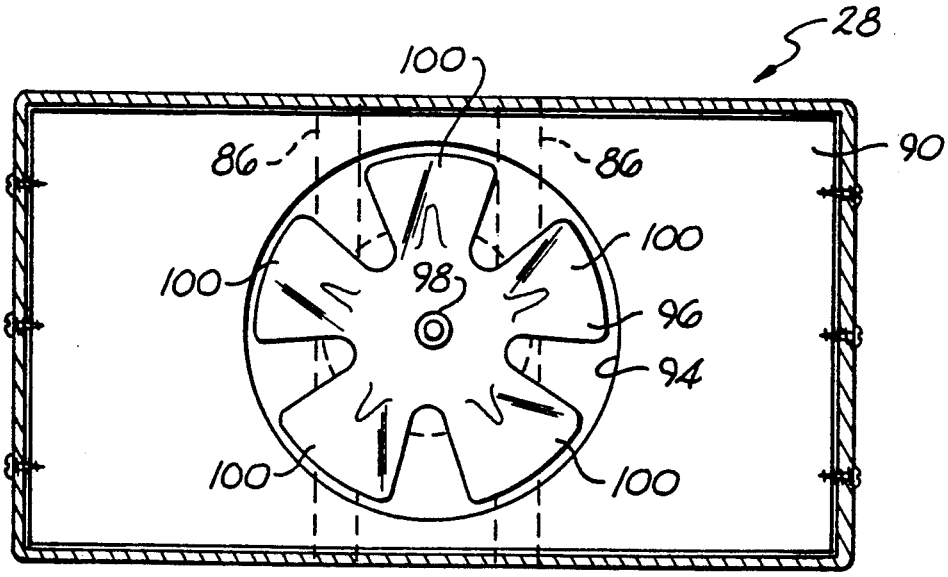
FIG. 5 illustrates a cross-sectional view taken along the lines 5—5 of FIG. 4 and having certain components shown in phantom with dashed lines.

The first ventilator further desirably includes means for mounting a fan. Fan mounting means desirably is disposed in opposition to the rear edge of the fan housing. As shown in FIGS. 2, 4, and 5 for example, the fan mounting means desirably includes at least one mounting member 86 and desirably two mounting members 86 are provided and connected to the rear edge of fan housing 40 and carry a fan motor 88. A suitable embodiment of fan motor 88 is one rated for 1/100 horsepower at 115 volts AC and drawing 0.5 amps to generate 1,550 rpm's.

The first ventilator further desirably includes a fan orifice plate disposed across the air passageway of the fan housing and between the front and rear edges of the fan housing. As embodied herein and shown in FIGS. 4 and 5 for example, a fan orifice plate 90 desirably defines an orifice 94 through same. As shown in FIGS. 4 and 5 for example, the fan includes a fan blade 96 operatively disposed in orifice 94 of orifice plate 90. The fan blade 96 desirably is a six inch diameter blade that has a clockwise one-quarter inch bore on discharge. The diameter of the orifice 94 is six and one-quarter inches, and the fan blade 96 is centered in the orifice 94 with the plane of the hub portion 98 of the fan blade 96 disposed parallel to the plane of orifice plate 79. A preferred embodiment of the fan blade 96 is a Model L-2018 six-blade 100, six inch diameter, one-quarter inch bore on discharge available from the Swift Company of Wauseon, Ohio 43567. However, a five-blade 100 unit also can be used and is available from Air Drive Company of Libertyville, Ill. and sold under Model BOW-605-37. The fan has a motor 88 having an armature shaft 101 extending toward fan orifice plate 90, and fan blade 96 is attached to armature shaft 101. Desirably, orifice plate 90 is disposed a predetermined distance from first grill 68 of louver housing 38, and this distance preferably is the range of one and three eighths inches to one and five eighths inches with the most desirable separation distance being one and five eighths inches. The latter separation distance provides optimum fan exhaust capability for a six inch diameter fan blade, a rectangularly shaped fan housing air passageway with dimensions of about 6 inches by 15 inches, and a fan orifice plate having a circular shaped orifice 94 of six and one-quarter inches diameter.

The first ventilator also desirably includes means for electrically connecting the fan motor to a power source for powering the fan motor. The electric connecting means desirably is electrically connected to the fan motor. As embodied herein and shown in one or more of FIGS. 1–4 and 6 for example, the electric connecting means desirably includes electrically conducting wire 92 and further can include an electrical plug 102.

The apparatus of the present invention further desirably includes means for controlling electrically connecting the fan motor via the electric connecting means depending upon a predetermined level of detected humidity. The humidity dependent control means desirably is electrically connected in series between the fan motor and the electric connecting means. As embodied herein and shown in FIGS. 1, 3 and 6 for example, the humidity dependent control means desirably includes a humidistat 104 (contained inside control apparatus housing 32 in FIG. 1 and not otherwise shown) and electric wire 92 which electrically connects the humidistat 104 in series between the fan motor 88 and the wires 92 that carry the power from the power source 36 to the fan motor 88. Thus, the electric fan's motor 88 is activated depending upon the level of humidity detected by a sensor which forms part of humidistat 104, which controls the supply of electric power to the fan's electric motor 88. However, the louvers 54 in the louver housing 38 open and close independently of operation of the electric fan's motor 88.

The apparatus of the present invention further desirably includes means for controlling electrically connecting the fan motor via the electric connecting means depending upon a predetermined level of detected temperature. The temperature dependent control means desirably is electrically connected in series between the fan motor and the electric connecting means. As embodied herein and shown in FIGS. 1, 3 and 6 for example, the humidity dependent control means desirably includes a thermostat 106 (contained inside control apparatus housing 32 in FIG. 1 and not otherwise shown) and electric wire 92 which electrically connects the thermostat 106 in series between the fan motor 88 and the wires 92 that carry the power from the power source 36 to the fan motor 88. Thus, the electric fan's motor 88 is activated depending upon the level of temperature detected by a sensor which forms part of thermostat 106, which controls the supply of electric power to the fan's electric motor 88. However, the louvers 54 in the louver housing 38 open and close independently of operation of the electric fan's motor 88.

The apparatus of the present invention further desirably includes means for controlling electrically connecting the fan motor via the electric connecting means depending upon a predetermined level of detected temperature wherein this temperature dependent control means is electrically connected in series between the fan motor and the electric connecting means and electrically connected in parallel with respect to the humidity dependent control means. As embodied herein and shown in FIG. 6 for example, the humidistat 104 is connected in series between the fan motor 88 and the power source 36. The thermostat 106 also is connected electrically in series between the fan motor 88 and the power source 36. Moreover, the humidistat 104 and the thermostat 106 are electrically connected in parallel with respect to one another, sharing a first common terminal 108 to the fan motor 88 and a second common terminal 110 to the power source 36.

The apparatus of the present invention further desirably includes means for controlling electrically connecting the fan motor via the electric connecting means depending upon the desires of the operator. This operator dependent control means desirably is electrically connected in series between the fan motor and the electric connecting means. The operator dependent control means allows the operator to decide whether the fan motor shall be rendered incapable of operating notwithstanding any automatic control provided by either the temperature dependent control means or the humidity dependent control means. As embodied herein and shown in FIGS. 1, 3 and 6 for example, the operator dependent control means desirably includes a manually operable on/off electric switch 34 disposed in series between the fan motor 88 and the power source 36. More than one manually operable on/off electric switch 34 can be used as shown in FIGS. 3 and 6 to provide power to the fan motor 88 notwithstanding the status of the humidity dependent control means and the temperature dependent control means. Thus, the supply of electric power to the fan's motor 88 is controlled by an on/off short circuiting of the power supply 36. As schematically shown in FIG. 1 for example, this on/off switch 34 typically is disposed in a room such as the kitchen of the building structure such as a house where the occupant can deprive the humidity sensor or the temperature sensor of its ability to turn on the fan when for example the occupant desires to retain heat inside the house rather than expel moisture from the crawl space 24 beneath the house.

The apparatus of the present invention desirably includes in some embodiments a second ventilator. As embodied herein and shown schematically in FIG. 1 for example, the second ventilator 30 can be a conventional ventilator that is neither temperature responsive nor humidity responsive. Examples of suitable second ventilators 30 which are not temperature responsive are disclosed in U.S. Pat. Nos. 4,821,628; 3,220,079; 4,274,330; 4,587,892; or U.S. Pat. No. 4,676,145, the disclosure of each of the foregoing patents being hereby incorporated herein by this reference. Alternatively, the second ventilator can be a temperature responsive ventilator such as disclosed in U.S. Pat. No. 4,328,927; 4,493,456; 4,715,532; 4,754,696; or U.S. Pat. No. 4,962,882, the disclosure of each of the foregoing patents being hereby incorporated herein by this reference. The second ventilator allows fresh air into the space when the fan is expelling air and moisture from the space.

The present invention pertains especially to ventilators in which substantially all of the parts other than the bimetallic spring, are fabricated with plastic and/or metal parts that have been formed in molds or dies.

What is claimed is:

1. Temperature-responsive powered-fan foundation ventilator apparatus, comprising:

a louver housing defining an air passageway therethrough, said housing defining a front edge and a rear edge opposite said front edge;

means for selectively opening and closing said louver housing air passageway depending upon ambient temperature, said ambient temperature dependent opening and closing means being disposed in said air passageway of said louver housing;

a fan housing defining an air passageway therethrough, said housing defining a front edge and a rear edge opposite said front edge, said front edge of said fan housing being disposed in opposition to said rear edge of said louver housing;

means for mounting a fan, said fan mounting means being disposed in opposition to said rear edge of said fan housing;

a fan carried by said fan mounting means;

a fan orifice plate disposed across said air passageway of said fan housing and between said front and rear edges of said fan housing and defining an orifice through said orifice plate; and said fan including a fan blade operatively disposed in said orifice of said orifice plate.

2. Apparatus as in claim 1, wherein said temperature dependent opening and closing means includes:

at least two elongated louvers, each said louver defining a longitudinal axis of rotation;

means for supporting each said louver for rotation about said longitudinal axis of rotation;

an elongated drive element pivotally connected to at least one of said louvers;

means for linking said louvers for simultaneous rotation about each longitudinal axis of rotation of each said louver;

a bimetallic coil having a free end disposed outside said coil and engaging said drive element, said coil having an opposite free end disposed inside said coil.

3. Apparatus as in claim 1, further comprising:

a first grill disposed across said air passageway of said louver housing and in the vicinity of said front edge of said fan housing and said rear edge of said louver housing, said orifice plate being disposed a predetermined distance from said first grill;

said fan motor having an armature shaft extending toward said fan orifice plate; and said fan motor including an armature shaft, said fan blade being attached to said armature shaft.

4. Apparatus as in claim 1, wherein said fan mounting means includes:

at least one fan mounting member disposed in opposition to said rear edge of said fan housing, said fan motor being carried by said fan mounting member.

5. Apparatus as in claim 1, further comprising:

means for electrically connecting said fan motor to a power source for powering said fan motor, said electric connecting means being electrically connected to said fan motor.

6. Apparatus as in claim 5, further comprising:

means for controlling electrically connecting said fan motor via said electric connecting means depending upon a predetermined level of detected humidity, said humidity dependent control means being electrically connected in series between said fan motor and said electric connecting means.

7. Apparatus as in claim 6, wherein said humidity dependent control means includes:

a humidistat.

8. Apparatus as in claim 5, further comprising:

means for controlling electrically connecting said fan motor via said electric connecting means depending upon a predetermined level of detected temperature, said temperature dependent control means being electrically connected in series between said fan motor and said electric connecting means.

9. Apparatus as in claim 8, wherein said temperature dependent control means includes:

a thermostat.

10. Apparatus as in claim 5, further comprising:

means for controlling electrically connecting said fan motor via said electric connecting means depending upon operator decision, said operator dependent control means being electrically connected in series between said fan motor and said electric connecting means.

11. Apparatus as in claim 10, wherein said operator dependent control means includes:

a manually operable on/off electric switch.

12. Apparatus as in claim 5, wherein said means for electrically connecting said fan motor to a power source for powering said fan motor, includes:

electrically conducting wire.

13. Apparatus as in claim 12, wherein said means for electrically connecting said fan motor to a power source for powering said fan motor, further includes:

an electrical plug.

14. Temperature-responsive powered-fan foundation ventilator apparatus, comprising:

a louver housing defining an air passageway therethrough, said housing defining a front edge and a rear edge opposite said front edge;

means for selectively opening and closing said louver housing air passageway depending upon temperature, said temperature dependent opening and closing means being disposed in said air passageway of said louver housing;

a fan housing defining an air passageway therethrough, said housing defining a front edge and a rear edge opposite said front edge, said front edge of said fan housing being disposed in opposition to said rear edge of said louver housing;

means for mounting a fan, said fan mounting means being disposed in opposition to said rear edge of said fan housing;

a fan carried by said fan mounting means;

a fan orifice plate disposed across said air passageway of said fan housing and between said front and rear edges of said fan housing and defining an orifice through said orifice plate;

said fan including a fan blade operatively disposed in said orifice of said orifice plate;

means for electrically connecting said fan motor to a power source for powering said fan motor, said electric connecting means being electrically connected to said fan motor;

means for controlling electrically connecting said fan motor via said electric connecting means depending upon a predetermined level of detected humidity, said humidity dependent control means being electrically connected in series between said fan motor and said electric connecting means; and means for controlling electrically connecting said fan motor via said electric connecting means depending upon a predetermined level of detected temperature, said temperature dependent control means being electrically connected in series between said fan motor and said electric connecting means and electrically connected in parallel with respect to said humidity dependent control means.

15. Apparatus as in claim 14, wherein said operator dependent control means includes:

a manually operable on/off electric switch.

16. Apparatus as in claim 14, wherein said means for electrically connecting said fan motor to a power source for powering said fan motor, includes:

electrically conducting wire.

17. Apparatus as in claim 16, wherein said means for electrically connecting said fan motor to a power source for powering said fan motor, further includes:

an electrical plug.

* * * * *